United States Patent [19]

Johnson

[11] Patent Number: 4,706,825

[45] Date of Patent: Nov. 17, 1987

[54] PORTABLE FOLDING BRIDGE CRANE

[75] Inventor: Bruce S. Johnson, Dallastown, Pa.

[73] Assignee: Harsco Corporation, Wormleysburg, Pa.

[21] Appl. No.: 736,834

[22] Filed: May 22, 1985

[51] Int. Cl.[4] ..... B66C 23/26

[52] U.S. Cl. ..... 212/182

[58] Field of Search ..... 212/205-221, 212/182-183, 189, 257; 280/475, 479 R, 479 A; 414/541-543, DIG. 917; 104/93, 110

[56] References Cited

U.S. PATENT DOCUMENTS

| | | | |
|---|---|---|---|
| 910,038 | 1/1909 | Andrews . | |
| 1,879,607 | 9/1929 | Fitch . | |
| 1,905,434 | 7/1930 | Boyer . | |
| 2,557,253 | 6/1951 | Belden | 414/542 |
| 2,772,004 | 11/1956 | Noble . | |
| 3,052,365 | 9/1962 | Cameron | 414/542 |
| 3,120,316 | 2/1964 | Luchford | 212/218 |
| 3,161,309 | 5/1960 | Baudhuin et al. . | |
| 3,315,825 | 4/1967 | Scheinert | 414/542 |
| 3,348,700 | 10/1966 | Williford . | |
| 3,540,610 | 11/1970 | Pontani | 280/491 R |
| 3,645,405 | 2/1972 | Stiglich . | |
| 3,759,409 | 9/1973 | Wenzel et al. . | |
| 3,760,953 | 9/1973 | Cibin | 212/185 |
| 3,768,670 | 10/1973 | Cloud | 212/225 |
| 3,784,035 | 1/1974 | Dunbar | 212/189 |
| 3,841,495 | 10/1974 | Dronick et al. . | |
| 3,848,751 | 11/1974 | Holland, Sr. | 414/542 |
| 3,863,782 | 2/1975 | Sandrock | 414/542 |
| 3,973,679 | 8/1976 | Hass et al. | 212/205 |
| 4,041,974 | 8/1977 | Keiser | 280/491 R |
| 4,241,803 | 12/1980 | Lauber | 212/189 |
| 4,270,456 | 6/1981 | Theurer et al. . | |
| 4,290,731 | 9/1981 | Griffith | 212/189 |

FOREIGN PATENT DOCUMENTS

| | | | |
|---|---|---|---|
| 868657 | 2/1953 | Fed. Rep. of Germany | 212/189 |
| 1204794 | 11/1965 | Fed. Rep. of Germany | 212/218 |
| 2408510 | 4/1975 | Fed. Rep. of Germany | 212/185 |
| 1333368 | 6/1963 | France | 212/218 |
| 2499050 | 8/1982 | France | 212/188 |
| 1177810 | 1/1970 | United Kingdom | 212/185 |

*Primary Examiner*—Jeffrey V. Nase
*Assistant Examiner*—R. Johnson
*Attorney, Agent, or Firm*—Kerkam, Stowell, Kondracki & Clarke

[57] ABSTRACT

A portable folding bridge crane comprises a power unit having a folding tongue assembly for enabling the unit to be towed as a trailer by a vehicle, a crane rail assembly carrying a movable bridge crane thereon, a pair of support members pivotally connected to the unit and to an intermediate location of the rail assembly, first hydraulic actuators for pivoting the support members with respect to the unit to raise and lower the rail assembly, second hydraulic actuators for simultaneously pivoting the rail assembly with respect to the support members to maintain the rail assembly horizontal, and a pair of legs pivotally supported at the front of the rail assembly for movement between a stowed position at which the legs lie adjacent to the rail assembly and an operating position at which the legs are extended to engage the ground. Upon being erected, the rail assembly is supported by the front legs and by the support members connected to the power unit, and the tongue assembly is folded against the power unit to enable vehicles to be driven sideways beneath the rail assembly and the movable bridge crane to be employed for transferring loads to and from the vehicles.

20 Claims, 12 Drawing Figures

PORTABLE FOLDING BRIDGE CRANE

BACKGROUND OF THE INVENTION

This invention relates generally to portable crane apparatus, and more particularly to portable, folding crane apparatus of the bridge or gantry type.

There are many instances in which it is desirable to establish quickly and easily a temporary freight or load handling facility. Building contractors, for example, have a need for unloading building materials from trucks at a construction site, and freight transfer companies are often faced with the problem of loading or unloading freight at locations which do not have freight handling apparatus. The military has a particularly critical need for temporary freight handling facilities which may be easily and quickly erected in a field environment, as for supplying combat units, and which may be quickly disassembled and transported to other locations. Essential to such temporary facilities are portable cranes or other load handling apparatus. Although cranes or other lifting devices may sometimes be provided on the vehicles used to transfer freight, this is not practical for some types of vehicles, tractor-trailer trucks, for example, and, in any event adds unnecessary complication and expense to the vehicle. Accordingly, it is desirable to provide separate portable crane apparatus which may be easily transported to a temporary freight handling facility and erected, and then quickly collapsed and moved to another location. Although portable cranes, both self-propelled and otherwise, are known, known cranes have a number of disadvantages for temporary load handling facilities, particularly in a military environment.

It is desirable to provide crane apparatus which avoids these and other disadvantages of known apparatus, and it is to this end that the present invention is directed.

SUMMARY OF THE INVENTION

The invention affords portable, lightweight and versatile crane apparatus that folds into a compact trailer configuration for towing by a vehicle, such as a truck, so that it may be easily transported to a desired location. Upon reaching the desired location, the apparatus may be quickly unfolded to an erected position, and uncoupled from its towing vehicle to establish a freight handling facility. When its job is completed, the crane apparatus may be quickly folded back into a trailer configuration and towed to a new location.

Preferably, the crane apparatus is a bridge or gantry type crane which has its own self-contained power unit, and which independently folds and unfolds itself to go from a trailer configuration to an erected or operating configuration.

Briefly stated, the crane apparatus may comprise a wheeled unit having a tongue assembly adapted for connection to a vehicle to enable towing of the unit. A rail assembly which carries a movable crane assembly thereon is pivotally connected to a support structure which in turn is pivotally connected to the unit, and first means is included for pivoting the support structure with respect to the unit to raise and lower the rail assembly. Leg means is pivotally connected to the rail assembly at one end region thereof, and second means is included for pivoting the leg means between a stowed position at which the leg means is folded adjacent to the rail assembly and an operating position at which the leg means is folded away from the rail assembly to support the end region above the ground.

In accordance with more specific aspects, the tongue assembly may comprise a pair of hinged link members connected to actuating means for folding the hinged members together adjacent to the unit. For towing, the tongue assembly is extended. Upon the apparatus being towed to the desired location, the first pivoting means may be operated to begin raising the rail assembly, and the actuating means may be operated to cause the hinged linked members of the tongue assembly to fold together. This pulls the wheeled unit adjacent to the rear of the towing vehicle, which may be a truck. As the rail assembly is raised, it moves forward over the back of the vehicle until the support structure assumes a substantially vertical position. The second means pivots the leg means at the end region of the rail assembly away from the stowed position adjacent to the rail assembly to a substantially vertical position so that the leg means may engage the ground to support the end region of the rail assembly. The leg means are shaped such that the distance between them is greater than the width of the vehicle, thereby enabling the leg means to be lowered into engagement with the ground on opposite sides of the vehicle. The tongue assembly may be then disconnected from the vehicle, and the vehicle driven out of the way. This leaves the rail assembly supported in a horizontal position by the leg means connected to the end region of the rail assembly and by the support structure connected to the unit. Grousers may be extended downwardly from the frame of the unit to stabilize the crane and to take the weight off of the axle of the unit. The grousers may be hydraulically operated, and the leg means may have hydraulically extendable pads so that the apparatus may be erected level over uneven ground and stabilized with the rail assembly in a substantially horizontal position.

Upon the crane apparatus being erected, trucks may be driven beneath the rail assembly, and the movable crane assembly may be employed for loading and unloading freight. When operations are concluded, the sequence of steps may be reversed to fold the crane apparatus back into a trailer configuration so that it may be towed to a new location.

Other advantages and features of the invention will become apparent from the description which follows.

DESCRIPTION OF THE PREFERRED EMBODIMENT

The invention is particularly well adapted for use by the military in a field environment for transferring artillery projectiles to and from supply vehicles, and will be described in that context. However, as will become apparent, this is illustrative of only one utility of the invention.

Figure 1:
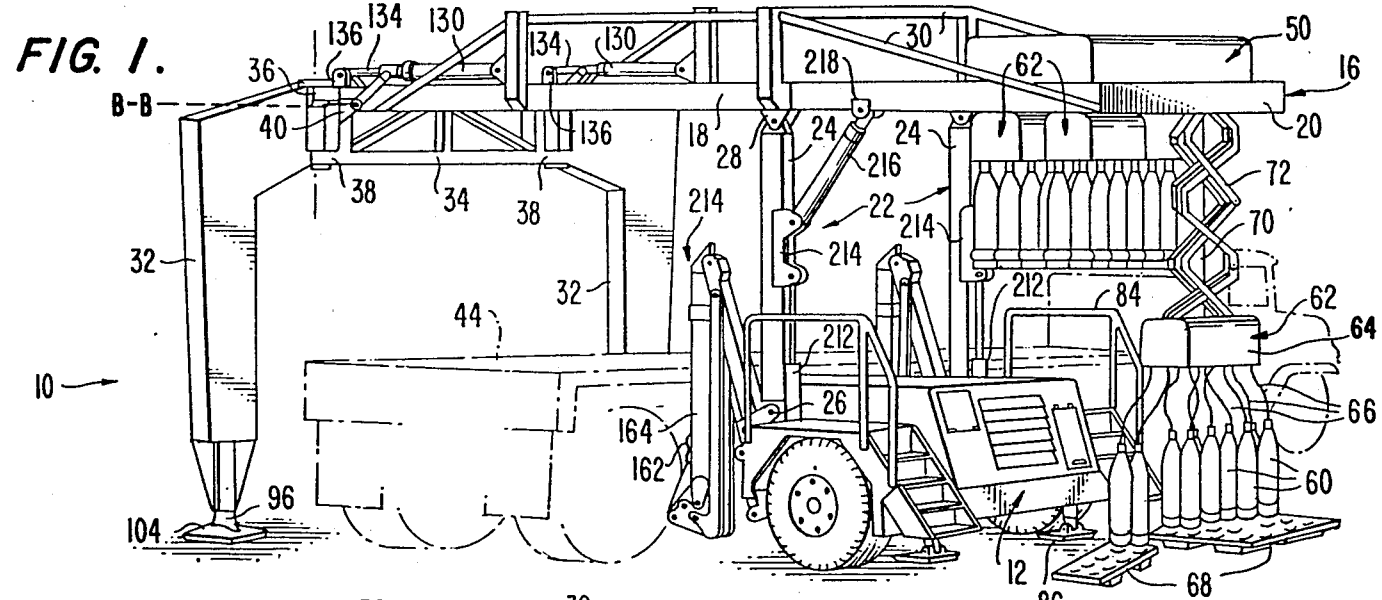
FIG. 1 is a perspective view illustrating crane apparatus in accordance with the invention in an erected or operating position.
Figure 2:
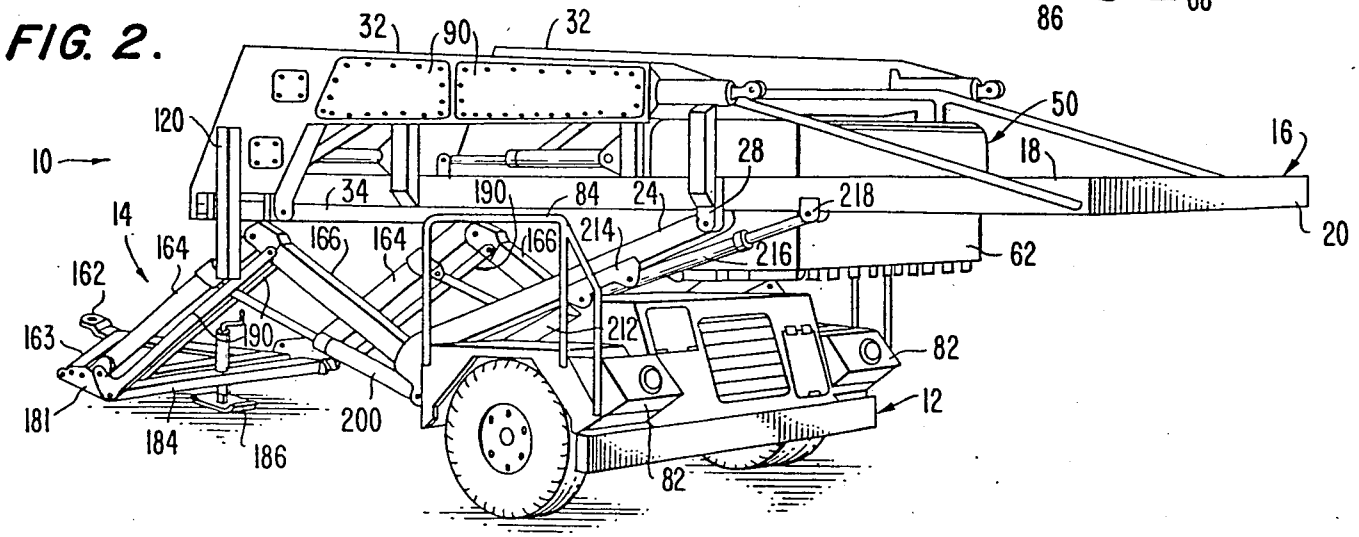
FIG. 2 is a perspective view showing the crane apparatus of FIG. 1 in a folded or trailer configuration.

As noted earlier, the invention affords portable crane apparatus which folds itself into a trailer configuration so that it may be towed by a vehicle, such as a truck, to a desired location, and which quickly unfolds and erects itself to form a bridge or gantry type crane. FIG. 1 illustrates crane apparatus 10 in accordance with the invention in an erected or operating configuration, and FIG. 2 illustrates the crane apparatus folded into a trailer configuration for towing. As shown in FIGS. 1 and 2, and as will be described more fully hereinafter, the apparatus may comprise a wheeled power unit 12 having a folding tongue assembly 14 (illustrated in more detail in FIG. 4) to enable towing of the unit. A crane rail assembly 16, which may comprise a pair of longitudinally extending rails 18 connected at their ends by transversely extending cross members 20 (only one rail and cross member being shown in the figures) to form a substantially rectangular frame, may be connected to unit 12 by a main support assembly 22 comprising a pair of rigid posts 24 having one end 26 pivotally connected to unit 12 and having an opposite end 28 pivotally connected to rails 18 of the frame rail assembly at an intermediate location thereof. Each rail 18 of the rail assembly may be reinforced by a double truss structure 30, as shown.

The front end (the left end in FIGS. 1 and 2) of the rail assembly has pivotally connected thereto a pair of legs 32 for supporting the front end of the rail assembly above the ground, as shown in FIG. 1, when the crane apparatus is erected. The legs preferably pivot with respect to the rail assembly about two substantially perpendicular axes, a first axis A—A, which is substantially vertical in FIG. 1, and a second axis B—B, which is substantially horizontal in FIG. 1 and which extends transversely between the two rails 18 of the crane rail assembly. This enables the legs to be folded to a stowed position at which the legs are adjacent to the sides of the crane rail assembly, as shown in FIG. 2, for towing of the apparatus. To enable such pivoting of the legs, they may be connected to opposite ends of a transversely extending front frame assembly 34 so that the legs pivot about axis A—A with respect to the front frame assembly, and the front frame assembly may be pivotally connected about axis B—B to the front end of the crane rail assembly.

Figure 6A:
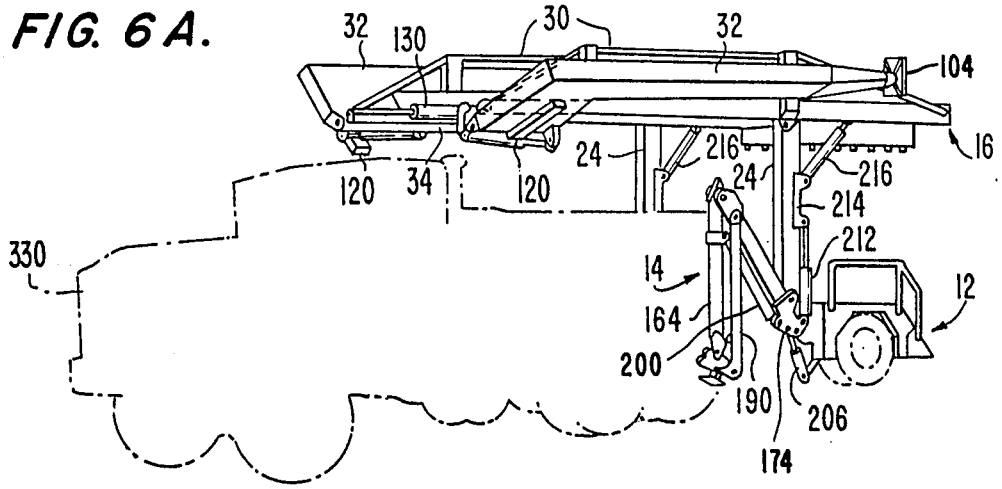
FIGS. 6A–C are perspective views showing a sequence of unfolding steps by which the apparatus is erected.
Figure 6B:
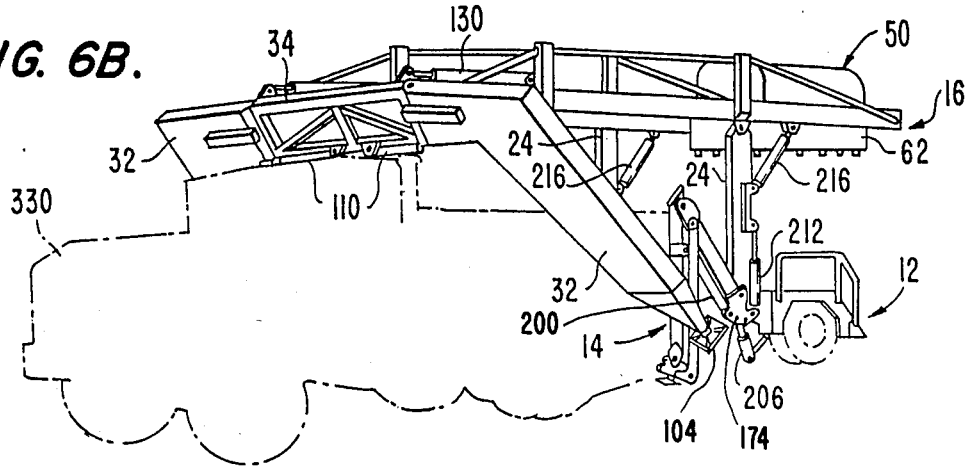
Figure 6C:
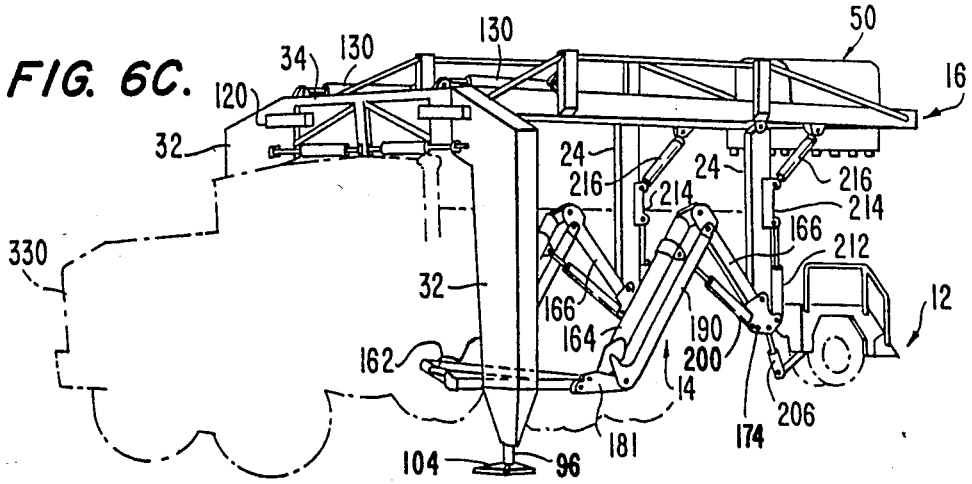

As shown in FIGS. 1, 6B and 6C, front frame assembly 34 may comprise a substantially rectangular, reinforced framework having at each end upper and lower laterally extending ears 36 and 38, respectively, to which the legs are pivotally connected for rotation about axis A—A, and may have at each end a rearwardly extending ear or flange 40 by which the front frame assembly is pivotally connected to the rails 18 for rotation about axis B—B. In stowed position, the front frame assembly is pivoted about axis B—B (counterclockwise in FIG. 1) so that it is folded adjacent to the underside of the front end of rails 18, and the legs are pivoted counterclockwise about axis A—A so that they are located adjacent to the sides of the crane rail assembly. The manner in which the legs are rotated between their folded and unfolded positions will be described shortly.

As best shown in FIG. 1, in erected position, the crane rail assembly is supported in a substantially horizontal position by front legs 32 and by main posts 24 of main support assembly 22 with the rear portion of the crane rail assembly being cantilevered beyond the rear of power unit 12. Tongue 14 is folded adjacent to the front of the power unit, as shown, and the distance between the front legs and the tongue is selected to enable a vehicle such as a truck 44 to be driven sideways underneath the crane rail assembly between the front legs and the folded tongue. A rolling bridge assembly 50 (shown in more detail in FIGS. 5A–C) is carried by the crane rail assembly for longitudinal movement along rails 18. Bridge assembly 50 may include one or more lifting mechanisms, such as winches and cables, for lifting and transferring loads, such as artillery projectiles 60, to and from truck 44. For handling artillery projectiles, bridge assembly 50 may be equipped with a plurality of slings or grouping heads 62 for handling a group of projectiles as a unit. The grouping heads may be similar, for example, to that disclosed in U.S. Pat. No. 4,381,164, issued Apr. 26, 1983, and assigned to the assignee of the present invention. Alternatively, in the form illustrated in FIG. 1, each grouping head may comprise a housing 64 having extending therefrom a plurality of cables 66 which are adapted for connection to the tops of projectiles 60. Cable take-up mechanisms such as reels (not illustrated) may be enclosed within housing 64 for taking up the slack in cables 66. When cables 66 are extended, they may be easily connected to the tops of randomly ordered projectiles 60 located on wooden pallets 68, for example. Upon the cables being taken up, the group of projectiles connected to the cables is arranged in a predetermined configuration so that the projectiles may be inserted as a group into a magazine or the like. Each grouping head may be raised and lowered by a single cable 70 connected to a lifting device within bridge assembly 50, and may be connected to the underframe of the bridge assembly by a folding scissors mechanism 72 which stabilizes the grouping head with respect to the bridge assembly and encloses control lines such as hydraulic hoses and electrical cables.

Crane apparatus 10 may be powered hydraulically and/or electrically. As shown in FIGS. 1 and 2, power unit 12 may be a two-wheeled trailer-like unit which encloses within a housing 80 an engine driven electrical generator and hydraulic power unit (not illustrated). The fenders of the unit may include fold-down steps 82 and handrails 84 and function as an operator work platform. Unit 12 may also have a pair of hydraulically operated rear grousers or pads 86 which may be extended downwardly into engagement with the ground from the undercarriage of the power unit when the crane apparatus is erected so as to take the weight off of the axle and wheels and for leveling of the power unit, as will be described in more detail shortly. Apparatus 10 may also include a plurality of hydraulic actuators which cooperate to raise and lower the crane rail assembly, fold and unfold the front legs, and operate the folding tongue assembly.

Figures 3A, 3B, 3C:
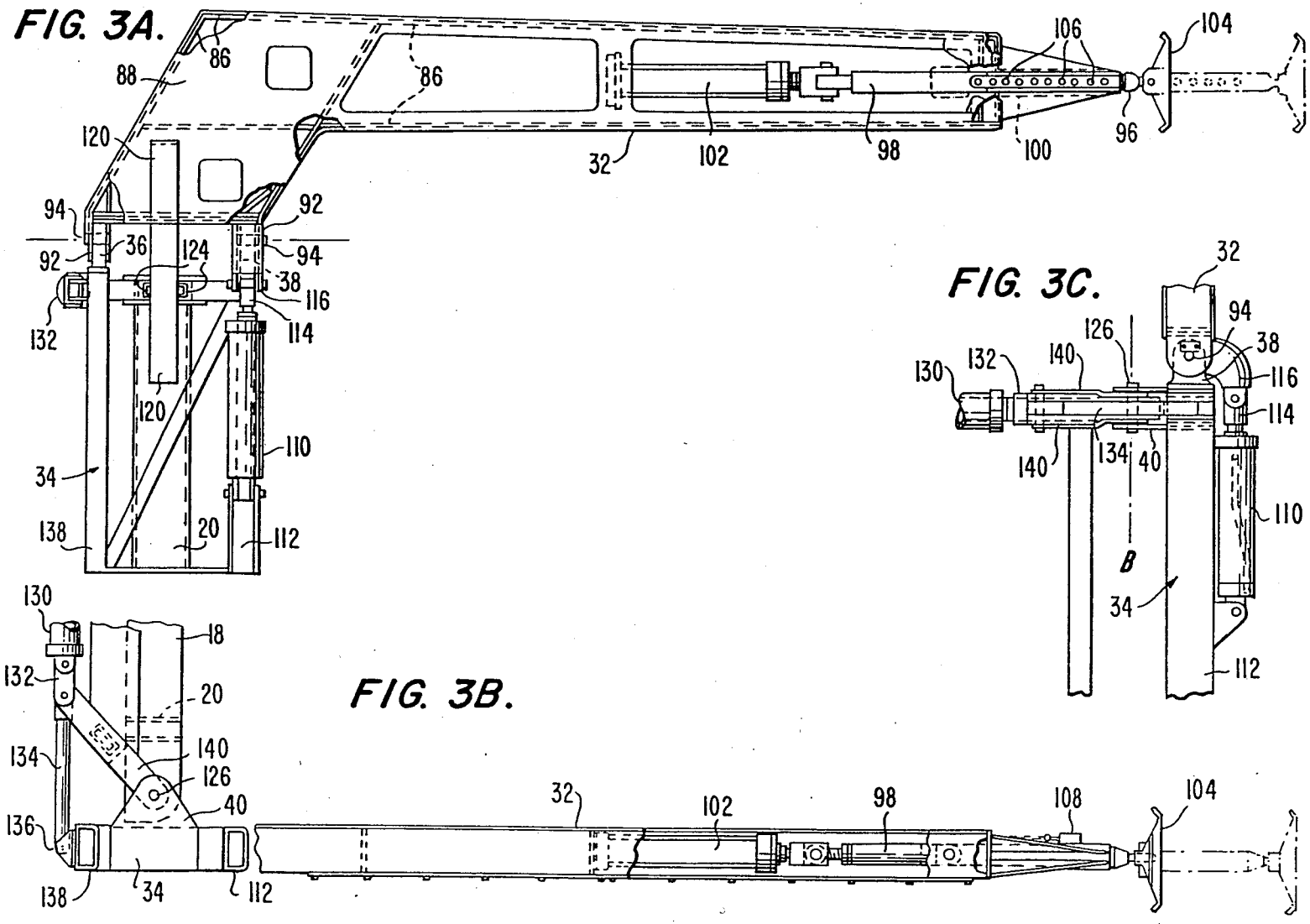
FIG. 3A is a plan view, partially broken away, of a leg assembly and a portion of a front frame assembly of the crane apparatus.
FIG. 3B is a side view, partially broken away, of the leg assembly looking downwardly from the top of FIG. 3A.
FIG. 3C is a partial side view of the leg assembly looking from the left of FIG. 3A.

FIGS. 3A–C illustrate the preferred construction of the front legs 32 and their attachment to front frame assembly 34. As shown in FIG. 3A, each leg 32 may comprise a plurality of girders 86 connected together to form a framework which is covered by plates 88 to form an enclosed box construction. Inspection plates 90 (best illustrated in FIG. 2) may be included for access to the interior of the leg, as for maintenance of hydraulic components. As shown in FIG. 3A, each leg may be provided with spaced flanges 92 to enable connection of the leg to ears 36 and 38 of the front frame assembly 34 as by pins 94. The legs are preferably shaped so as to extend transversely outwardly from frame assembly 34, as shown, for reasons to be explained.

Each leg preferably has an extendable foot portion 96, which may be constituted by a rod 98 slidably received within a bore 100 of the leg and connected to a hydraulic cylinder 102 disposed within the interior of the leg. The external end of rod 98 may have a pad 104 thereon for engaging the ground, and the rod may have a plurality of longitudinally spaced holes 106 into one of which a locking pin 108 (see FIG. 3B) may be inserted for locking the foot in an extended position.

As previously noted, the legs are pivotally connected to upper and lower ears 36 and 38 of front frame assembly 34 so as to pivot about an axis A—A. As best illustrated in FIGS. 3A and 3C, each leg may be pivoted by a hydraulic cylinder 110 which is connected to a lower member 112 of the front frame assembly and which has its movable piston connected by a clevis 114 to a curved link 116 attached to the leg. Upon cylinder 110 being actuated, the piston extends and causes leg 32 to pivot counterclockwise (in FIG. 3C) about a pivot through pins 94 which corresponds to axis A—A. As shown in FIGS. 2 and 3A, the upper portion of the leg may have attached to its frontside a beam 120 having a rectangular or square cross section which positively locks into catches 124 (see FIG. 3A) of the front frame assembly when the leg is pivoted to lie in the same plane as the front frame assembly. (Beam 120 has been omitted in FIG. 3C for clarity.)

As best illustrated in FIG. 3B, ears 40 of front frame assembly 34 are pivotally connected to the end of rails 18 at 126 (the transverse axis between the rails through pivots 126 corresponding to axis B—B) of FIG. 1. The front frame assembly may be pivoted by hydraulic cylinders 130 mounted on the tops of the rails and having their movable pistons connected by a clevis 132 and a member 134 to a bracket 136 connected to the top member 138 of the front frame assembly. A link 140 may have one end pivotally connected at 126 to rail 18 and its opposite end connected to the end of member 134 adjacent to clevis 132, as shown. The triangular structure formed by link 140, member 134 and the front frame assembly is rigid, and upon cylinder 130 being actuated, the piston extends causing the front frame assembly to pivot 90° about pivot 126 until its lower member 112 lies adjacent to the underside of rails 18.

As shown in FIGS. 1 and 6C, folding tongue assembly 14 comprises a pair of folding link assemblies 160 (one of which is shown in more detail in FIG. 4) which are pivotally connected to opposite sides of the front of the power unit 12 and to a towing pintle 162 attached to a yoke 163 that extends between the folding links. Since both folding links may be the same, a description of one will suffice.

Figure 4:
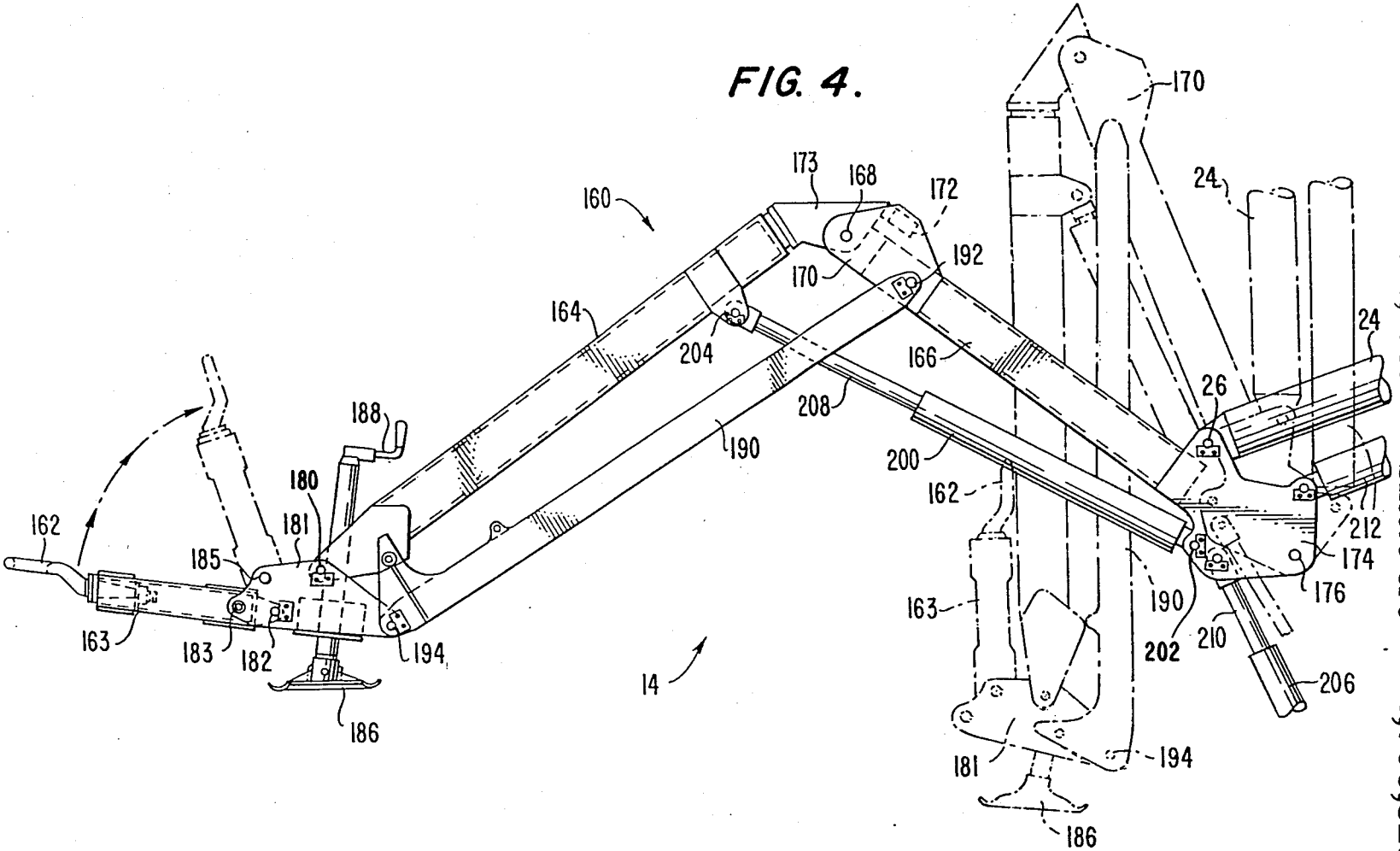
FIG. 4 is a side view of a folding tongue assembly of the apparatus.

Referring to FIG. 4, each link assembly may comprise a pair of primary link members 164, 166, each of which may comprise a tubular member having a rectangular cross section. The primary link members may be pivotally connected together at 168 between a a pair of parallel plates 170 (only one being shown in FIG. 4) which are attached on opposite sides of link member 166 and which are provided with a stop 172 that an angled end 173 of member 164 engages when the tongue is fully extended (to the position illustrated in solid lines in FIG. 4). The opposite end of member 166 may be connected to a pair of parallel plates 174 (only one being shown in FIG. 4) which are pivotally connected at a pivot 176 to power unit 12. The opposite end of link member 164 from pivot 168 is pivotally connected at 180 to a pair of plates 181, which provide a pivotal connection 182 for the yoke 163. A transverse reinforcing member 184 may extend between the plates 181 of the spaced folding link assemblies, as shown in FIG. 2, and member 184 may support a manually operable foot 186 which may be cranked up and down by a handle 188 to support the ends of the link assemblies to which the yoke is connected. A pair of flat parallel link members 190 (only one being shown in FIG. 4) preferably extends between plates 170 and plates 181 generally parallel to member 164, the ends of the flat link members 190 being pivotally connected to the plates at 192 and 194, respectively. These flat link members serve to control the motion of plates 180 and the towing pintle and yoke as the tongue assembly folds and unfolds, the folded position of the tongue assembly being illustrated in phantom lines in the figure. Link members 164 and 166 of each folding link assembly 160 are preferably folded and unfolded by a hydraulic cylinder 200 which is pivotally connected at 202 to plates 174 and at 204 to member 164, as shown, and by another hydraulic cylinder 206 (only partially shown in FIG. 4) which is pivotally connected to plates 174 and to the frame of the power unit. Upon the piston 208 of cylinder 200 being retracted, and the piston 210 of cylinder 206 being extended, plates 174 rotate about pivot point 176 and the link members fold together to the phantom line position indicated in the figure. Of course, both of the spaced folding link assemblies 160 are operated simultaneously for folding and unfolding the tongue assembly.

Also pivotally connected to plates 174 are main post 24 of the main support assembly 22 and a hydraulic cylinder 212 which extends substantially parallel to the main post and has its movable piston pivotally connected to a bracket 214 located at approximately the midpoint of the main post, as shown in FIG. 1. As is also shown in FIG. 1, another hydraulic cylinder 216 is pivotally connected to bracket 214 and has its movable piston pivotally connected at 218 to an associated rail 18 of the crane rail assembly. As will be described shortly, cylinder 212 causes the main post 24 to pivot between its folded position (shown in FIG. 2) and its substantially vertical position (shown in FIG. 1) to raise and lower the crane rail assembly. Cylinder 216 cooperates with cylinder 212 to maintain the crane rail assembly substantially horizontal during raising and lowering.

As is also indicated in FIG. 4, the towing pintle and yoke may be pivoted about pivot point 182 to the phantom line position indicated in the figure, i.e., clockwise, when the tongue assembly is in folded position. This allows the towing pintle and yoke to be located adjacent to member 164, as shown in phantom lines, so that they are out of the way. The towing pintle and yoke may be held in either the solid or the phantom line positions indicated in the figure by a locking pin inserted, through an appropriate hole 183 or 185 in plates 180.

Figure 5A:
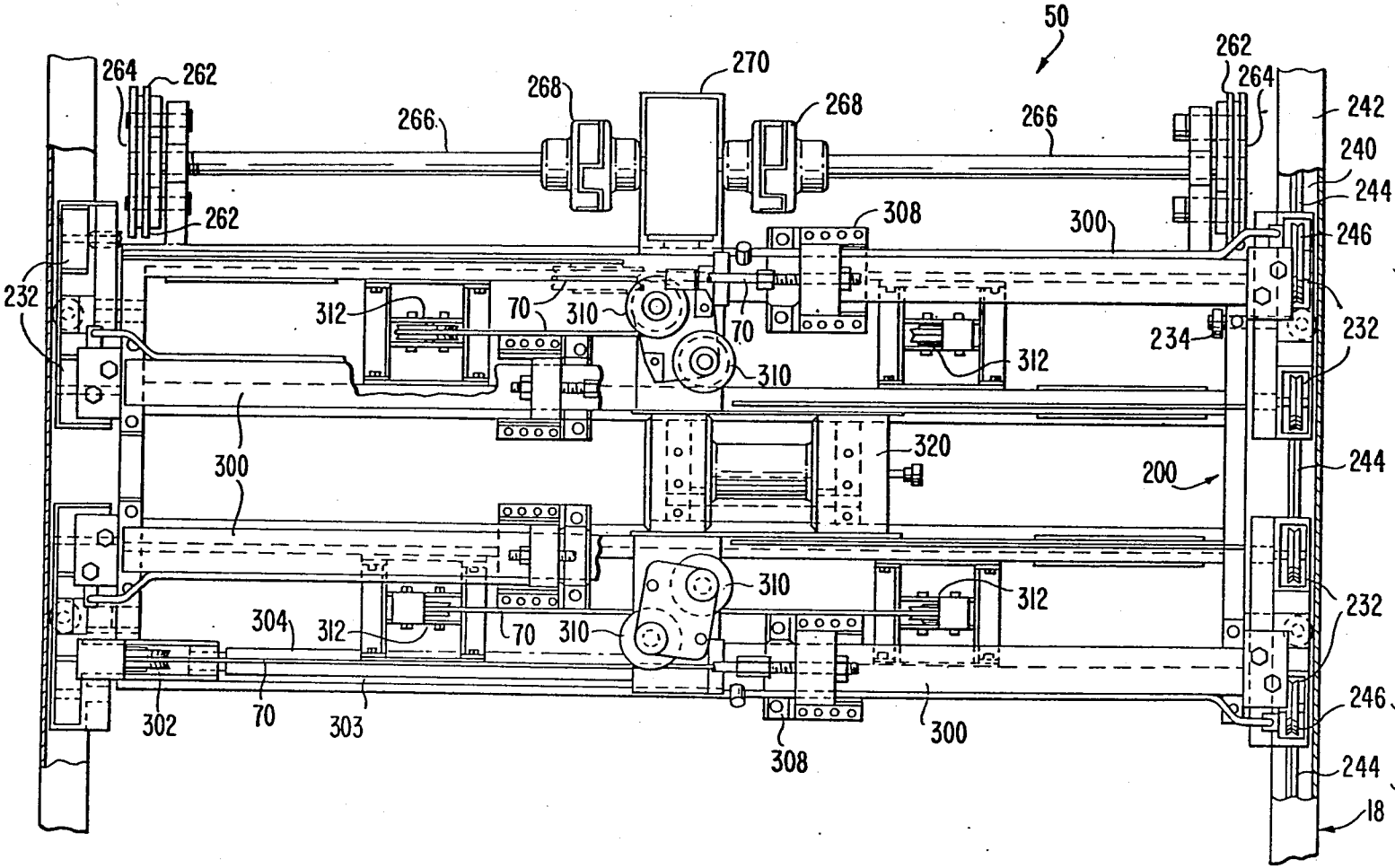
FIGS. 5A–C are, respectively, a top plan, an end elevation, and a side elevation view of a crane bridge assembly of the apparatus.
Figure 5B:
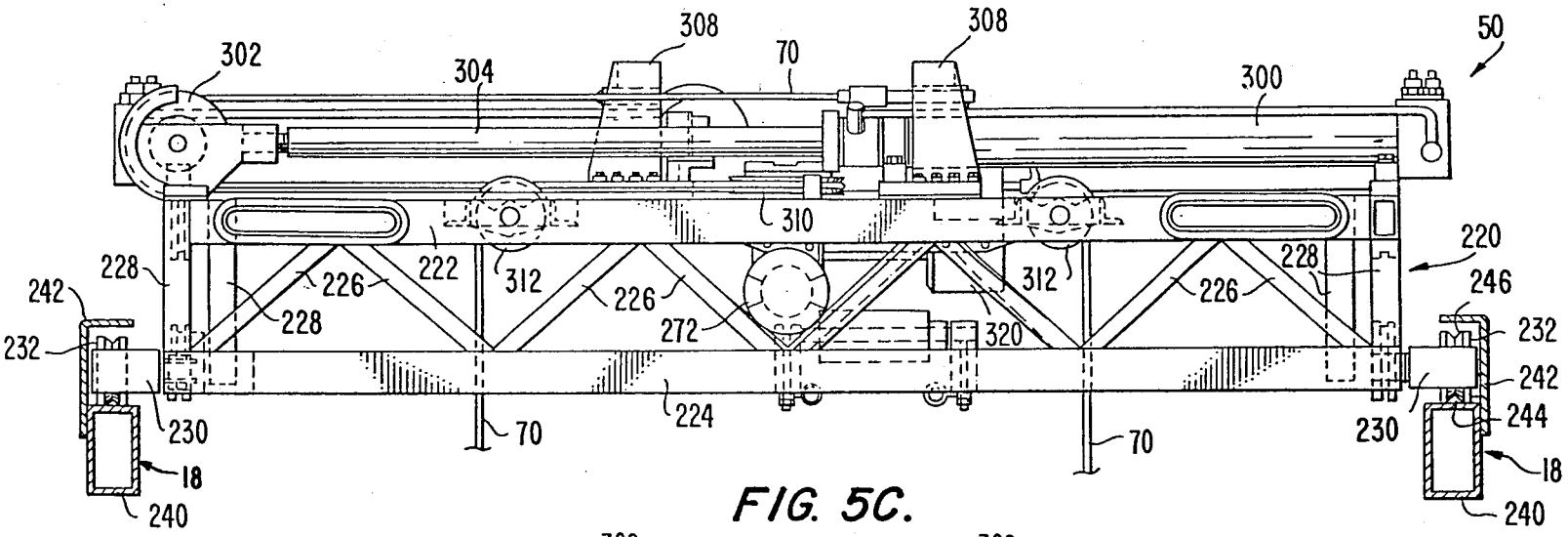
Figure 5C:
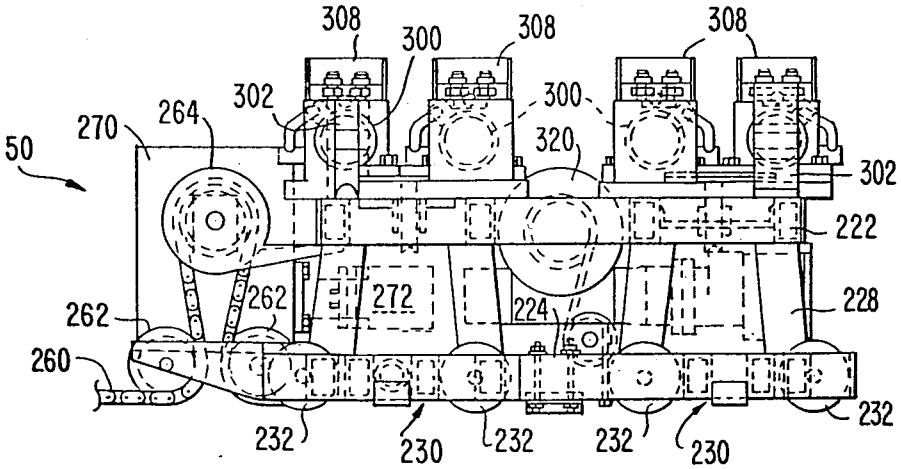

FIGS. 5A–C illustrate a rolling crane or bridge assembly 50. As shown, the bridge assembly may comprise a substantially rectangular structure 220 comprising an upper frame 222 and a lower frame 224 interconnected by bracing members 226 and 228, the frames being sized to extend between rails 18 of the frame rail assembly. Four truck assemblies 230, each having a pair of spaced wheels 232 may be connected to the lower frame 224, two to a side, as shown in FIG. 5A, so as to ride along rails 18. The truck assemblies on one side of the frame (the right side in FIG. 5A, for example) are preferably pivotally connected about their midpoint at 234 to the lower frame. This insures that the wheels of the truck assemblies remain in contact with the rails in the event that there is any slight misalignment or warping of the rails.

As shown in FIG. 5B, rails 18 are preferably rectangular (in cross section) tubular members 240 upon which the wheels 232 ride, and may have a L-shaped piece of sheet metal 242 connected thereto to form a channel in which the wheels are positioned, as shown. In addition, one of the rails preferably has a longitudinally extending inverted V-shaped bar 244 disposed thereon which mates with a corresponding V-shaped groove 246 in the wheels of the corresponding truck assemblies. This insures that the wheels track properly along the rail during movement of the bridge assembly.

In order to move the bridge assembly along the rails, a dual chain and sprocket arrangement may be employed. The arrangement may comprise two lengths of chain having their ends fixed at the front and rear cross members 20 of the crane rail assembly and located adjacent to the side rails so as to extend parallel thereto, and drive sprockets carried by the bridge assembly which connect to the chains. FIG. 5C illustrates a portion of one such chain 260. As shown, the chain may pass over a pair of idler sprockets 262 on the lower frame of the bridge assembly and be looped around a drive sprocket 264 supported on the upper frame of the bridge assembly. As shown in FIG. 5A, the drive sprockets 264 (one on each side of the bridge assembly) may be connected by shafts 266 and couplings 268 to a generally centrally located gear reducer 270 which may be driven by a small hydraulic or electric reversible motor 272 (see FIG. 5B), preferably having fail-safe braking. Since the ends of the two lengths of chain 260 are fixed, when motor 272 is operated, drive sprockets 264 turn and cause the bridge assembly to be pulled along the chains and, accordingly along the rails. Hydraulic and/or electrical power for operating the bridge assembly may be supplied from unit 12 via lines which are not illustrated in the figures.

In the form illustrated in the figures, bridge assembly 50 is adapted to handle four grouping heads 62. Accordingly, the bridge assemblly may have at least four separate lifting mechanisms, one for each grouping head. FIGS. 5A–C illustrate one form of a lifting mechanism which may be employed. Since all lifting mechanisms may be similar, a description of only one will be given.

As shown, four hydraulic cylinders 300 (one for each grouping head) may be disposed on the upper frame 222 of the bridge assembly so as to extend transversely with respect to the rails. Each cylinder 300 may have a pulley 302 slidingly disposed on a transverse guide 303 and connected to the end of its movable piston 304 such that the transverse location of pulley 302 may be varied in accordance with the movement of the piston. A cable 70 for lifting a grouping head may have one end attached to a fixed support 308 adjacent to the cylinder 300 and may extend parallel to piston 304 and around movable pulley 302. After passing around the pulley, the cable is then fed back toward the transverse midpoint of the bridge assembly and around a fixed pulley 310 located at approximately the midpoint and oriented so as to lie in a substantially horizontal plane. After passing around pulley 310, the cable is then directed back toward the side of the frame assembly and is passed around another fixed pulley 312 disposed approximately halfway between the midpoint and the side of the bridge assembly and oriented so as to lie in a substantially vertical plane. After passing around pulley 312, cable 70 extends downwardly from the bridge assembly, as shown in FIG. 5B, and may be connected to a grouping head.

Referring to FIG. 5B, upon piston 304 being retracted, pulley 302 moves inwardly to the right in the figure. This increases the length of cable 70 which extends from the bridge assembly and lowers the grouping head attached thereto. Upon piston 304 being extended, pulley 302 moves outwardly toward the side of the bridge assembly (to the position illustrated in FIG. 5B), thereby shortening the length of cable which extends from the bridge assembly and raising the grouping head. The lifting mechanism, accordingly, employs the linear motion of a hydraulic cylinder piston for raising and lowering the grouping head or other devices attached to the cable. Preferably, the arrangement of the lifting mechanism is such that a piston movement of one unit of distance produces a two unit change in the length of cable extending from the bridge assembly.

All four lifting mechanisms may be substantially identical and operate in the same manner, the only difference being that they are oriented so that the cables extend from the bridge assembly at different locations thereof (the locations of the pulleys 312 shown in FIG. 5A).

As also shown in FIG. 5A, the bridge assembly may further include a hydraulically or electrically operated winch 320 to enable the bridge crane to be employed for handling other kinds of loads. Moreover, if desired, the previously described hydraulic cylinder and movable pulley lifting mechanisms may be replaced by separate hydraulically or electrically driven winches, similar to winch 320, in which case four winches located at the positions of pulleys 312 in FIG. 5A would be required for handling four grouping heads. Regardless of which type of lifting mechanisms is employed, each lifting mechanism, as well as winch 320, are preferable independently operable.

FIGS. 6A–C illustrate the sequence of operations involved in erecting the crane apparatus. As previously noted, the crane apparatus is towed to a desired location (as, for example, by a 5-ton cargo truck 330 shown in phantom lines in FIGS. 6A–C) with the crane apparatus in the folded trailer configuration shown in FIG. 2. Upon reaching the desired location, the parking brake of the towing vehicle is set, and the foot pads 104 (which may be removed for towing as shown in FIG. 2) are attached to the feet 96 of legs 32. Power unit 12 is then started, and the hydraulic cylinders 200 and 206 associated with the folding tongue assembly are actuated to begin folding the tongue assembly together toward the phantom line position illustrated in FIG. 4. As the tongue assembly is folded, it causes power unit 12 to be pulled toward the rear of the towing vehicle. Simultaneously with operating hydraulic cylinders 200 and 206, hydraulic cylinders 212 and 216 associated with the main posts 24 of the main support assembly are actuated to raise the crane rail assembly. Extending the pistons of cylinders 212, which are pivotally connected to plates 174 of the tongue assembly as previously described, causes the main posts to pivot from the position illustrated in FIG. 2 toward vertical, which raises the crane rail assembly. At the same time, retracting the pistons of hydraulic cylinders 216, which are extended when the crane apparatus is in a folded condition, as shown in FIG. 2, causes the crane rail assembly to remain in a substantially horizontal position as it is raised. At the crane rail assembly is being raised, power unit 12 rolls toward the rear of truck 330 by virtue of the folding tongue assembly, causing the crane rail assembly to pass over the top of the truck as shown in FIG. 6A. Upon the tongue assembly reaching its folded position, hydraulic cylinders 110 pivot front legs of the apparatus 90° with respect to the front frame assembly until the legs lie in a substantially horizontal plane and bars 120 lock in catches 124 of the front frame assembly. Hydraulic cylinders 130 are then operated to pivot the front frame assembly downwardly from the underside of the crane rail assembly, as shown in FIG. 6B. The actuators pivot the front frame assembly 90° to the position illustrated in FIG. 6C, at which legs 32 are substantially vertical. With respect to FIG. 6C, it should be noted that tongue 162 is shown in its extended position. The extended position of tongue 162 is shown merely for illustrative purposes and it should be readily apparent that in the present operating sequence, tongue 162 is in its folded position as shown in FIGS. 6A and 6B. As previously described, legs 32 are shaped such that they extend outwardly from the front frame assembly and so that the distance between the legs exceeds the width of the truck, thereby allowing the legs to be positioned on opposite sides of the truck.

Upon assuming the position illustrated in FIG. 6C, the hydraulic actuators 102 (FIG. 3A) within the front legs 32 are operated to extend to feet 96 until pads 104 engage the ground, and the rear grousers 86 are lowered from beneath the power unit into engagement with the ground. The hydraulic actuators associated with feet 96 and rear grousers 86 (FIG. 1) may then be operated to level the crane rail assembly. This may be accomplished by using bubble levels and by manually operating the individual hydraulic actuators associated with the legs and grousers, or the apparatus may include an automatic self-leveling control system. The ability to individually control the legs and the grousers is particularly advantageous in permitting the apparatus to be erected over unlevel ground. Truck 330 may then be uncoupled from the towing pintle of the tongue assembly, and the truck driven out from beneath the erected crane apparatus. Trucks 44 may then be driven sideways beneath the crane apparatus (as shown in phantom lines in FIG. 1), and the crane apparatus used for loading and unloading supplies such as projectiles.

To collapse the crane apparatus, the foregoing sequence of steps just described is reversed to fold the apparatus back into the trailer configuration illustrated in FIG. 2, at which it may be towed to a new location.

As may be appreciated from the foregoing, crane apparatus in accordance with the invention may be quickly and easily erected to establish a temporary load handling facility, and may be readily collapsed and folded back into a trailer configuration so that it may be towed to a new location as required. Especially advantageous is the fact that the crane apparatus incorporates its own power source which functions both to erect and collapse the apparatus, as well as to operate the bridge assembly for handling loads. The apparatus may be erected and collapsed substantially automatically by one or two persons, without the necessity for construction personnel. This makes it particularly ideal for use by the military where it is necessary to establish quickly, and usually on short notice, temporary load handling facilities in remote field environments.

While a preferred embodiment of the invention has been shown and described, it will be appreciated by those skilled in the art that changes may be made in this embodiment without departing from the principles and spirit of the invention, the scope of which is defined in the appended claims.

I claim:

1. Crane apparatus comprising a wheeled unit having a tongue assembly adapted for connection to a vehicle to enable towing of the unit; a rail assembly carrying a movable crane assembly thereon; a support structure pivotally connected both to the unit and to the rail assembly; first means for pivoting the support structure with respect to the unit to raise and lower the rail assembly; leg means pivotally connected to the rail assembly at an end region thereof; and second means for pivoting the leg means between a stowed position at which the leg means is folded adjacent to the rail assembly and an operating position at which the leg means is folded away from the rail assembly to support the end region of the rail assembly above the ground, and wherein the rail assembly comprises a pair of spaced parallel longitudinally extending rails, said leg means comprises two legs, each leg pivotably connected at an end region of a corresponding one of said rails.

2. The apparatus of claim 1, wherein the tongue assembly comprises a pair of hinged members and actuating means connected to the hinged members for folding the hinged members together adjacent to the unit.

3. The apparatus of claim 1, wherein each leg is pivotally connected at an end region of the corresponding rail for rotation about a pair of substantially perpendicular axes.

4. The apparatus of claim 3 further comprising a frame assembly extending between the rails at the end region, the frame assembly being pivotally connected to the rail assembly for rotation about a first axis transverse to the rails, and wherein the legs are pivotally connected to the frame assembly at opposite ends of the frame assembly for rotation about second axes perpendicular to the first axis, said first and second axes comprising said pair of substantially perpendicular axes.

5. The apparatus of claim 4, wherein the second pivoting means comprises first actuators for pivoting said frame assembly 90° about the first axis with respect to the rails, and second actuators for pivoting the legs 90° with respect to the frame assembly such that in the stowed position the frame assembly is folded against the rails and the legs are folded against the sides of the rails.

6. The apparatus of claim 3, wherein said legs have extendible and retractable feet to enable the length of each leg to be adjusted, and said unit has extendible and retractable feet for taking the weight of the unit off of its wheels, and wherein each of said feet includes independent operating means.

7. The apparatus of claim 1, wherein said first and second pivoting means comprise hydraulic actuators, and said unit comprises a hydraulic power unit for supplying power to the actuators.

8. The apparatus of claim 1 wherein said crane assembly comprises a bridge assembly spanning the rails, and drive means for moving the bridge assembly along the rails.

9. The apparatus of claim 8, wherein the bridge assembly has wheels on opposite sides thereof which roll on the rails, and wherein one of the rails has a V-shaped projection on its upper surface and the wheels which roll on such rail have a mating V-shaped groove.

10. The apparatus of claim 8, wherein the drive means comprises a chain having its ends fixed at opposite ends of the rails and which extends longitudinally adjacent to one of the rails, sprocket means carried by the bridge assembly and connected to the chain, and motor means carried by the bridge assembly for driving the sprocket means so as to pull the bridge assembly along the chain.

11. The apparatus of claim 8, wherein the bridge assembly further carries a cable lifting mechanism for lifting objects.

12. The apparatus of claim 11, wherein the cable lifting mechanism comprises a cable having one end fixed at the bridge assembly and another opposite end which extends from the bridge assembly and is adapted for connection to an object to be lifted, and a movable pulley carried by the bridge assembly and actuated by a linear actuator for shortening the cable extending from the bridge assembly so as to lift the object.

13. The apparatus of claim 11, wherein the cable lifting mechanism comprises a winch.

14. The apparatus of claim 1, wherein said first pivoting means comprises first actuators for pivoting the support structure with respect to the unit and second actuators for pivoting the rail assembly with respect to the support structure so as to maintain the rail assembly substantially horizontal as the rail assembly is raised and lowered.

15. Crane apparatus comprising a trailer adapted to be towed by a vehicle; a rail assembly carrying a movable bridge; means for raising and lowering the rail assembly with respect to the trailer; and a pair of legs pivotally connected at a front end of the rail assembly for movement between a stowed position at which the legs lie adjacent to sides of the rail assembly and an operating position at which the legs are folded away from the rail assembly and are extended to support the front end of the rail assembly above the ground.

16. The apparatus of claim 15, wherein said raising and lowering means comprises a pair of support members, each having one end pivotally connected to the trailer and having an opposite end pivotally connected to the rail assembly at an intermediate location of the rail assembly, and means for pivoting the support members with respect to the trailer and for simultaneously pivoting the rail assembly with respect to the opposite end of the support members so as to maintain the rail assembly substantially horizontal as it is raised and lowered.

17. The apparatus of claim 16, wherein the support members and the pivoting means are formed to move the rail assembly forward over the rear of said vehicle as the rail assembly is raised, and the legs are shaped such that they may be located on opposite sides of the vehicle when the legs are in the operating position.

18. The apparatus of claim 16, wherein, in a raised position the rail assembly has a rear portion which is cantilevered with respect to the trailer such that the rail assembly is supported by said pair of legs at said front end thereof and by said support members at said intermediate location.

19. The apparatus of claim 16, comprising first actuator means for pivoting the legs with respect to the rail assembly, and wherein said support members pivoting means comprises second actuator means for pivoting the support members with respect to the trailer, and third actuator means for pivoting the rail assembly with respect to the support members, said actuator means being powered by power means carried on said trailer.

20. The apparatus of claim 15 further comprising a folding tongue assembly connected to said trailer and having a towing pintle adapted for connection to said vehicle, the folding tongue assembly comprising a spaced pair of first and second link members pivotally connected together at a first end thereof, a second end of the first link members being pivotally connected to the trailer and a second end of the second link members being connected to a yoke carrying said towing pintle, and actuator means connected to said link members for folding the link members together at said trailer.

* * * * *